US010366848B2

(12) United States Patent
Berardengo et al.

(10) Patent No.: US 10,366,848 B2
(45) Date of Patent: Jul. 30, 2019

(54) METHOD FOR PRODUCING ELECTRIC SWITCHGEAR AND ELECTRIC SWITCHGEAR WITH ENHANCED SEAL-TIGHTNESS

(71) Applicant: Schneider Electric Industries SAS, Rueil-Malmaison (FR)

(72) Inventors: Florent Berardengo, Saint Martin le Vinoux (FR); Jean-Francois Tortorici, Jarrie (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/077,176

(22) Filed: Mar. 22, 2016

(65) Prior Publication Data

US 2016/0284485 A1 Sep. 29, 2016

(30) Foreign Application Priority Data

Mar. 27, 2015 (FR) ..... 15 52631

(51) Int. Cl.
*H01H 9/04* (2006.01)
*H01H 33/662* (2006.01)
*H01H 11/00* (2006.01)

(52) U.S. Cl.
CPC ..... *H01H 9/04* (2013.01); *H01H 11/00* (2013.01); *H01H 33/66207* (2013.01); *H01H 2033/6623* (2013.01)

(58) Field of Classification Search
CPC ..... H01H 9/04; H01H 33/66207; H01H 2033/6623; H01H 33/53; H01H 33/662; H01H 2223/002
(Continued)

(56) References Cited

U.S. PATENT DOCUMENTS 4,568,804 A 2/1986 Luehring
5,151,565 A 9/1992 Perret
(Continued)

FOREIGN PATENT DOCUMENTS

EP 0 412 479 A1 2/1991
WO WO 00/41 199 7/2000

OTHER PUBLICATIONS

French Preliminary Search Report dated Jan. 26, 2016 in French Application 15 52631 filed on Mar. 27, 2015 (with English Translation of Categories of Cited Documents.

*Primary Examiner* — Edwin A. Leon
*Assistant Examiner* — Lheiren Mae A Caroc
(74) *Attorney, Agent, or Firm* — Oblon, McClelland, Maier & Neustadt, L.L.P.

(57) ABSTRACT

A method for producing low- or medium-voltage electrical switchgear including an electrical component, at least one electrical connector connected electrically to the component and an enclosure delimiting a volume in which the component is received, in which the connector includes a body which passes through the enclosure, the method including a step of fitting a seal in a peripheral groove formed in the wall of the body and a step of injecting a plastic material around the body of the connector and around the seal, wherein the injection step consists in injecting the plastic material at a pressure causing an elastic crushing of the seal in the groove.

10 Claims, 3 Drawing Sheets

(58) Field of Classification Search
USPC ..... 200/302.1
See application file for complete search history.

(56) References Cited

U.S. PATENT DOCUMENTS

| | | | | |
|---|---|---|---|---|
| 9,691,574 | B2 * | 6/2017 | Gerovac | H01H 33/6606 |
| 2011/0133869 | A1 * | 6/2011 | Yan | F16J 15/43 335/205 |

* cited by examiner

METHOD FOR PRODUCING ELECTRIC SWITCHGEAR AND ELECTRIC SWITCHGEAR WITH ENHANCED SEAL-TIGHTNESS

TECHNICAL FIELD

The invention relates to low- or medium-voltage electrical switchgear comprising an outer enclosure produced to perfect the seal-tightness of its internal volume.

The invention relates more particularly to electrical switchgear comprising a conductor which is partly covered by the material of the enclosure and of which a part is in contact with the protection outside the enclosure, and comprising durable sealing means between the connector and the enclosure.

STATE OF THE ART

In low- or medium-voltage electrical switchgear, an electrical component, such as, for example, a vacuum interrupter, or any other switching device, and a connecting rod for transmitting mechanical movement made of insulating material, are mounted inside an enclosure which is formed to be seal-tight, notably to external pollutants.

The switchgear comprises conductors making it possible to electrically connect the switchgear to the electrical installation with which the switchgear is intended to be connected.

Each conductor is partially covered by the enclosure, the uncovered part of the conductor making it possible to electrically connect the conductor to another conductor which is associated with it.

The enclosure comprises a portion which covers a part of the conductor; sealing means are arranged between this portion of the enclosure and the covered part of the conductor.

According to a conventional embodiment, the enclosure is produced by moulding plastic material, preferably by injecting thermoplastic material or thermosetting material.

The seal-tightness between the enclosure and the conductor is generally implemented during the moulding operations, and entails the use of additional parts and components, as well as labour.

Also, in the case of which the enclosure is produced in thermosetting material, a surface treatment on the conductor has to be implemented prior to the moulding operation, in order to improve the adhesion between the material of the enclosure and the conductor.

These operations consequently involve an increase in the switchgear production time and also an increase in the manufacturing cost of the switchgear. The aim of the invention is to propose electrical switchgear, and a method for manufacturing this switchgear, for which the seal-tightness between the conductor and the enclosure is enhanced and entails fewer steps.

SUMMARY OF THE INVENTION

The invention proposes a method for producing low- or medium-voltage electrical switchgear comprising an electrical component, at least one electrical connector connected electrically to the component and an enclosure delimiting a volume in which the component is received, in which the connector comprises a body which passes through the enclosure, the method comprising a step of fitting a seal in a peripheral groove formed in the wall of the body and a step of injecting a plastic material around the body of the connector and around the seal, characterized in that the injection step consists in injecting the plastic material at a pressure causing an elastic crushing of the seal in the groove.

The elastic crushing of the seal under the action of the pressure of the material forming the enclosure makes it possible to guarantee a very good seal-tightness. Furthermore, the fact that this crushing is maintained on completion of the injection phase makes it possible to not implement any step specific to producing the seal-tightness between the conductor and the enclosure.

Preferably, on completion of the step of fitting the seal and before the implementation of the injection step, a part of the seal is situated outside of the groove.

Preferably, on completion of the step of fitting the seal and before the implementation of the injection step, a free volume is present between the seal and the groove.

The invention also proposes low- or medium-voltage electrical switchgear comprising:

- an electrical component;
- at least one connector of main axis A, which is electrically connected to the component, and which comprises a body in the outer face of which a peripheral groove coaxial to the main axis A is formed;
- an outer enclosure produced by plastic material injection which delimits a volume in which the component is received, the body of the connector passing through the enclosure;
- a seal which is arranged in the peripheral groove formed in the connector and which is covered by the outer enclosure, in which the enclosure comprises a sleeve-forming part comprising an inner face which is facing and in contact with the outer wall of the body of the connector and which is in contact with the seal, characterized in that the sleeve-forming part exerts on the seal a force compressing the seal in the annular groove.

Preferably, the groove comprises a part of which the dimension measured along the main axis A of the connector is less than the greatest axial dimension of the seal.

Preferably, the groove comprises an opening where the groove emerges in the outer wall of the body of which the length of the opening, measured along the main axis A of the connector, is less than the greatest axial length of the section of the groove.

Preferably, the connector comprises a lip situated at one and/or the other of the two sides of the opening of the groove.

Preferably, the section of the peripheral groove along an axial plane passing through the main axis A of the connector has a form chosen from a rectangular quadrilateral, a portion of a circle, an oval, a trapezoid or a hexagon.

Preferably, the connector comprises an end face situated outside the enclosure and the body of the connector consists of two parts situated axially on either side of the groove, of which the diameter of the part which is situated axially closest to the end face of the body is of a diameter greater than the diameter of the other part.

The end face of the connector makes it possible to facilitate the connecting or the separating of the connector to or from a conductor. The form of the body of the enclosure further makes it possible to easily remove the connector out of the sleeve-forming part and thus facilitate a subsequent recycling of the components of different materials.

Preferably, the section of the seal is of circular or annular or quadrilobal form.

Preferably, the peripheral groove comprises a bottom face and two lateral walls which are convex, dished towards the interior of the groove and the annular seal is a seal of the four-lobe type.

BRIEF DESCRIPTION OF THE DRAWINGS

Other features and advantages of the invention will become apparent on reading the following detailed description for an understanding of which reference will be made to the attached figures in which.

DETAILED EXPLANATION OF PARTICULAR EMBODIMENTS

Figure 1:
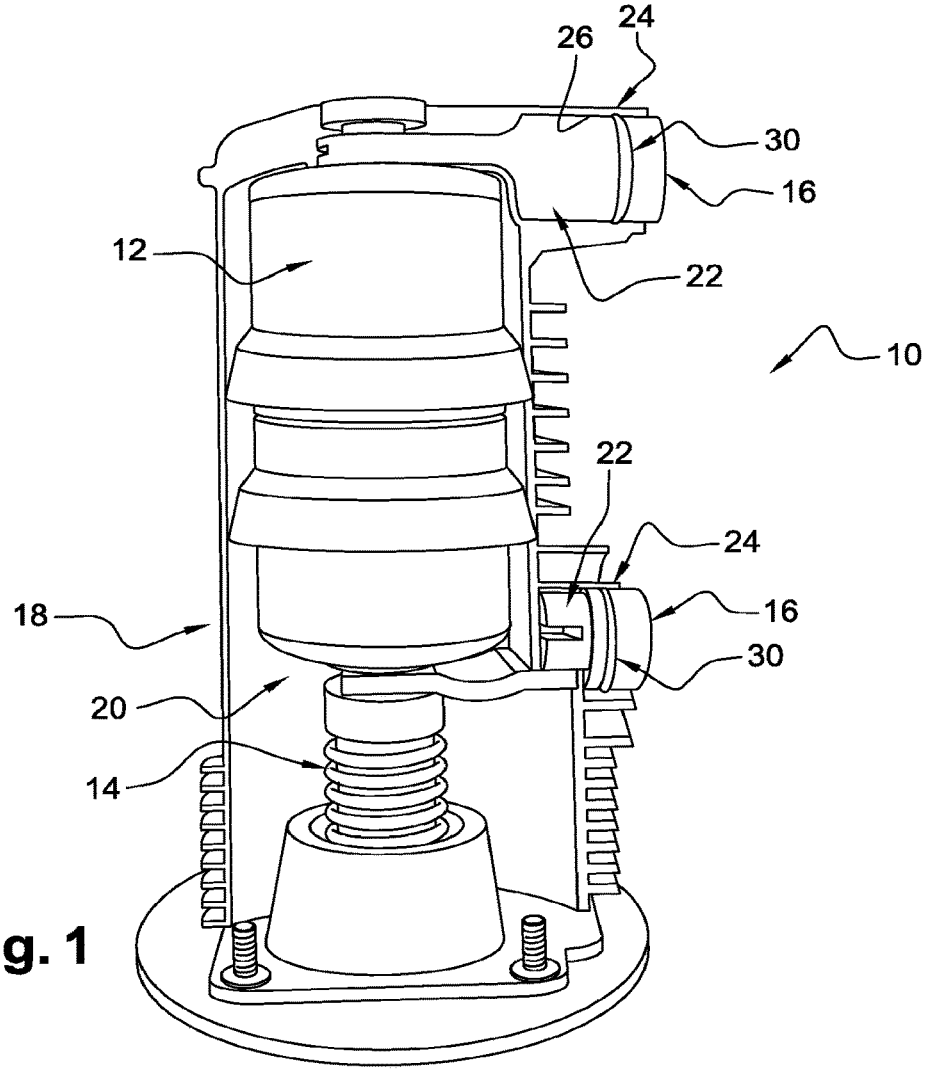
FIG. 1 is a perspective schematic representation in half-cross section of electrical switchgear according to the invention.

FIG. 1 shows low- or medium-voltage electrical switchgear 10, which comprises an electrical component 12, such as, for example here, a vacuum interrupter, a connecting rod 14 for manoeuvring and actuating the component 12, and two connectors 16 for electrically connecting each pole of the component 12 to a conductor of the low- or medium-voltage current line on which the switchgear 10 is intended to be mounted.

The switchgear 10 also comprises an enclosure 18 which delimits a volume 20 in which the component 12 and the manoeuvring connecting rod are received.

The internal volume 20 of the enclosure 18 is hermetically sealed to prevent polluting elements from outside disrupting the operation of the component 12 or the actuation mechanism 14.

Figure 2:
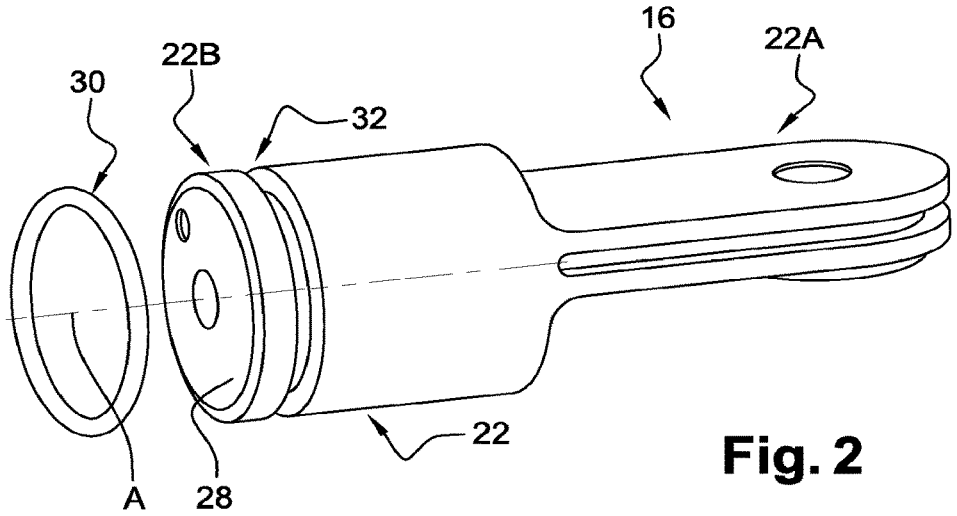
FIG. 2 is a larger scale detail showing a conductor, its peripheral groove and a seal intended to be received in the groove.

As can be seen in FIG. 2, each connector 16 comprises a main body 22 extending along its main axis A which is here horizontal, but which can have any other orientation.

Furthermore, here, the body 22 is of cylindrical revolution form. It will be understood that the invention is not limited to this embodiment and that the form of the body can be different from that represented. For example, the body 22 can have any other form of revolution or a section that is square for example.

A first end 22A of the body 22 is formed to be electrically connected to a pole of the component 12 which is associated with it, the other end 22B of the body 22 being formed for the connection of the connector 16 to a conductor of the electrical line.

Here, the second end 22B of the body 22 comprises a radial face 28 comprising mechanical link means to the associated conductor.

Thus, each connector 16 passes through the enclosure 18.

To guarantee the hermetic seal of the internal volume 20 of the enclosure 18, sealing means are arranged between the enclosure 18 and the connector 16.

The enclosure 18 comprises a sleeve-forming part 24 which surrounds the body 22 of the connector 16. This sleeve-forming part 24 comprises an inner face 26 which is situated facing the outer wall of the body 22 and which is in contact with said outer wall of the body 22.

The sealing means mentioned above comprise a seal 30, which here is an O-ring seal and which is arranged in a peripheral groove 32 which is associated with it. This groove 32 is formed in the outer wall of the body 22 of the connector 16.

Furthermore, the seal 30 is compressed radially between the sleeve-forming part 24 and the bottom of the groove 32, to guarantee that it is pressed against the inner face 26 of the sleeve-forming part.

The enclosure 18 is produced in a single piece by injection of thermoplastic material.

Preferably, this thermoplastic material is a material chosen form the following list: polyethylene PE, high-density polyethylene PE-HD, polyethyleneterephthalate PET, polybutyleneterephthalate PBT, polypropylene PP, polysulphide PS, polyamide PA, semi-aromatic polyamide PA HT; polyphthalamide PPA, poly arylamide PAA.

Upon its injection, the thermoplastic material, in its plastic or viscous state, is subjected to a high pressure to obtain the mechanical and electrical insulation properties necessary to produce the enclosure 18.

This pressure on the material in its plastic state is also used to provoke a deformation of the seal 30, crushing the latter in the associated groove 32.

Thus, on completion of the step of injection moulding of the enclosure 18, the seal 30 is compressed in the groove 32. This crushing of the seal 30 is an elastic deformation thereof, which allows the seal 30 to be pressed with a sufficiently great bearing force against the inner face 26 of the sleeve-forming part 24 which is associated with it.

The method for manufacturing the switchgear 10 comprises the following successive steps:

- a step of fitting each seal 30 in the associated groove 32 of the connector 16;
- a step of injection moulding of the enclosure 18 around the connectors 16 and the associated seals 30; and
- a step of assembling the components of the switchgear, namely, notably, assembling and connecting the component 12 and possibly the manoeuvring connecting rod 14.

The step of injection moulding of the enclosure 18 is implemented after each seal has been fitted on the associated connector 16.

This makes it possible to facilitate the fitting of the seal because the access to the groove 32 is relatively easy, contrary to the switchgear manufacturing methods for which the seal is fitted after the step of injection of the enclosure.

This also allows the sleeve-forming part 24 to cover the portions of the outer wall of the body 22 of the connector 16 which are situated on either side of the groove 32.

Also, the conditions of injection of the thermoplastic material, notably the high pressure, make it possible to guarantee a good contact of the sleeve-forming part 24 with the outer wall of the body 22 of the connector 16 by clamping or by banding, as a result of the injection pressure and of the cooling of the thermoplastic material.

As has been stated previously, the seal 30 is compressed in the groove 32 which is associated with it after the enclosure has been formed.

The section of the seal 30 is thus deformed, for the seal to fill almost all of the groove 32.

Figure 3A:
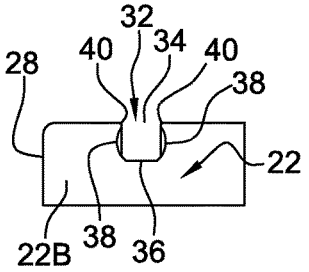
FIG. 3A illustrates a groove and seal, according to exemplary aspects of the present disclosure.
Figure 3B:
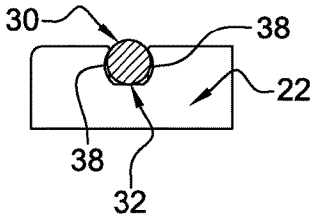
FIG. 3B illustrates a groove and seal, according to exemplary aspects of the present disclosure.
Figure 3C:
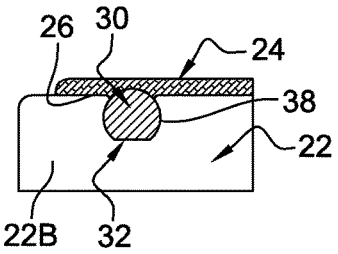
FIG. 3C illustrates a groove and seal, according to exemplary aspects of the present disclosure.
Figure 3D:
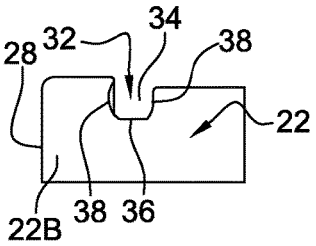
FIG. 3D illustrates a groove and seal, according to exemplary aspects of the present disclosure.
Figure 3E:
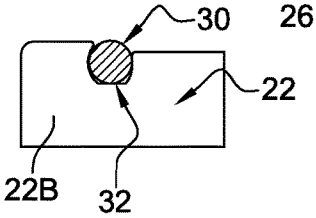
FIG. 3E illustrates a groove and seal, according to exemplary aspects of the present disclosure.
Figure 3F:
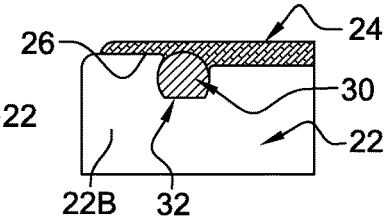
FIG. 3F illustrates a groove and seal, according to exemplary aspects of the present disclosure.
Figure 3G:
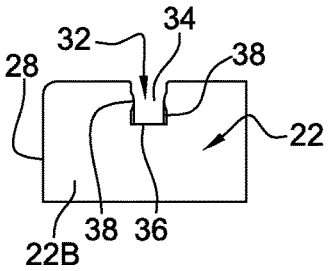
FIG. 3G illustrates a groove and seal, according to exemplary aspects of the present disclosure.
Figure 3H:
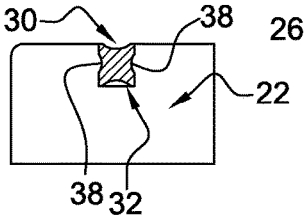
FIG. 3H illustrates a groove and seal, according to exemplary aspects of the present disclosure.
Figure 3I:
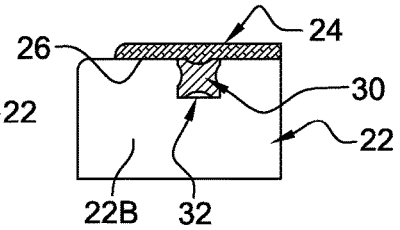
FIG. 3I illustrates a groove and seal, according to exemplary aspects of the present disclosure.
Figure 3J:
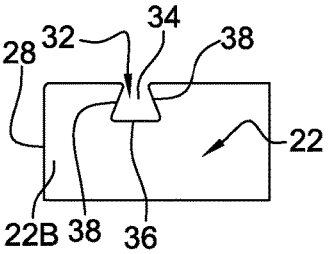
FIG. 3J illustrates a groove and seal, according to exemplary aspects of the present disclosure.
Figure 3K:
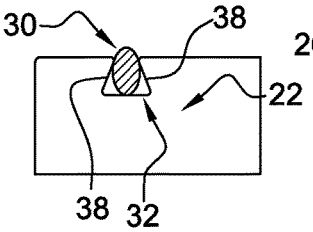
FIG. 3K illustrates a groove and seal, according to exemplary aspects of the present disclosure.
Figure 3L:
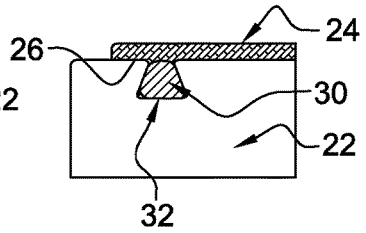
FIG. 3L illustrates a groove and seal, according to exemplary aspects of the present disclosure.
Figure 3M:
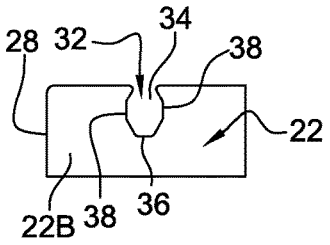
FIG. 3M illustrates a groove and seal, according to exemplary aspects of the present disclosure.
Figure 3N:
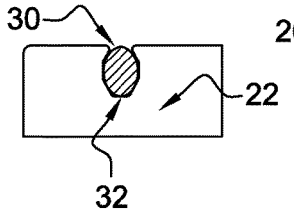
FIG. 3N illustrates a groove and seal, according to exemplary aspects of the present disclosure.
Figure 3O:
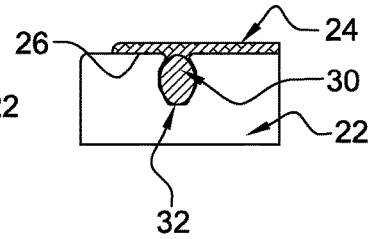
FIG. 3O illustrates a groove and seal, according to exemplary aspects of the present disclosure.
Figure 3P:
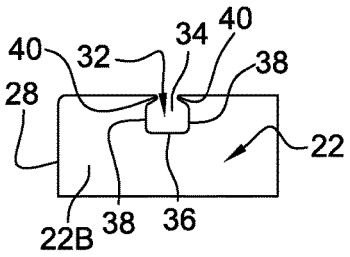
FIG. 3P illustrates a groove and seal, according to exemplary aspects of the present disclosure.
Figure 3Q:
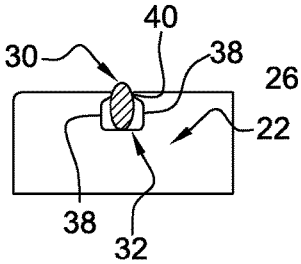
FIG. 3Q illustrates a groove and seal, according to exemplary aspects of the present disclosure.
Figure 3R:
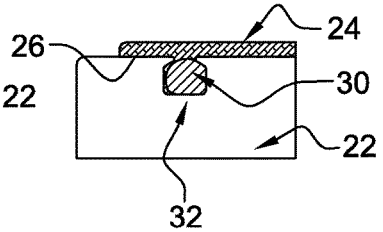
FIG. 3R illustrates a groove and seal, according to exemplary aspects of the present disclosure.
Figure 3S:
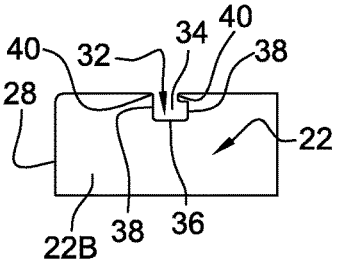
FIG. 3S illustrates a groove and seal, according to exemplary aspects of the present disclosure.
Figure 3T:
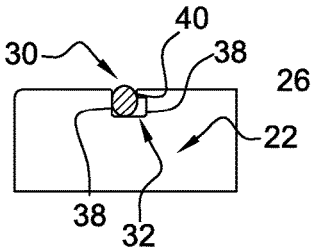
FIG. 3T illustrates a groove and seal, according to exemplary aspects of the present disclosure.
Figure 3U:
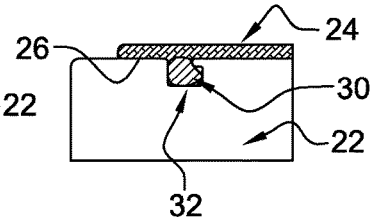
FIG. 3U illustrates a groove and seal, according to exemplary aspects of the present disclosure.
Figure 3V:
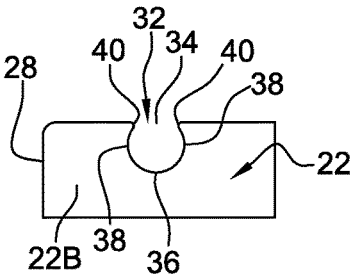
FIG. 3V illustrates a groove and seal, according to exemplary aspects of the present disclosure.
Figure 3W:
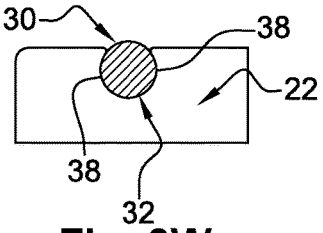
FIG. 3W illustrates a groove and seal, according to exemplary aspects of the present disclosure.
Figure 3X:
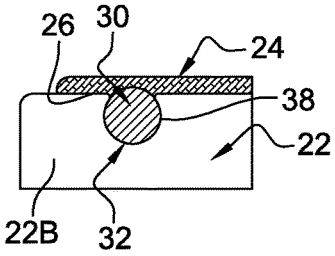
FIG. 3X illustrates a groove and seal, according to exemplary aspects of the present disclosure.

FIGS. 3A to 3X show different sections of the seal 30 and of the groove 32 which is associated with it, showing exemplary embodiments of the invention.

The groove 32 comprises an opening 34 where the groove 32 emerges in the outer face of the body 22; it also comprises a bottom wall 36 against which the seal 30 is intended to bear radially, and two lateral walls 38 which axially delimit the groove 32.

Here, the bottom wall 36 is of cylindrical form. It will be understood that the bottom wall 36 can have any other form and notably any other form of revolution centred on the main axis A of the connector 16.

According to a first aspect of the groove 32, the latter is formed to retain the seal 30 in position therein before and during the implementation of the step of injection moulding of the enclosure 18.

Preferably, the groove 32 comprises a part of which the dimension measured along the main axis A of the connector 16 is less than the greatest axial dimension of the seal 30.

According to first embodiment, the part of the groove 32 which is of reduced axial dimension is situated at the opening 34 of the groove 32. The edges of the opening 34 of the groove 32 are formed by the free ends of lips 40 situated at the outer radial ends of the lateral walls 38 of the groove 32. Examples of such lips 40 are represented in FIGS. 3A-3C, in FIGS. 3M-3O, and in FIGS. 3P-3R.

According to a variant embodiment, the groove 32 comprises a single lip 40, as can be seen in FIGS. 3S-3U.

According to another embodiment represented in FIGS. 3G-3I, the part of the groove 32 which is of reduced axial dimension is a median part of the groove 32. According to this embodiment, each lateral wall 38 of the groove 32 is of convex form and is dished axially towards the interior of the groove 32. Such a form of the groove 32 is particularly suited to a seal 30 of the so-called four-lobe type, that is to say a seal 30 having a section in the form of a quadrilateral with concave sides.

Each lobe of the seal 30 is received in a corner of the groove 32 and the radially inner lobes, which bear against the bottom wall 36, are retained radially by the dished parts of the lateral walls 38.

Different sections on an axial plane passing through the main axis A, of the groove 32 and of the seal 30, have been represented in FIGS. 3A to 3X.

According to the embodiments represented in FIGS. 3A-3C, in FIGS. 3D-3F, and in FIGS. 3V-3X, the section of the groove 32 is of mainly circular form, that is to say that the lateral walls are concave open axially towards the interior of the groove 32.

The embodiment of FIGS. 3D-3F differs from that of FIGS. 3A-3C in that the two parts of the outer face of the body 22, which are situated on either side of the groove 32, have a different diameter. Preferably, the part of greater diameter is that which is closest to the second end 22B of the body 22.

According to the embodiment of FIGS. 3V-3X, the section of the groove is in the form of a portion of a circle interrupted at the opening 34 of the groove 32.

According to the embodiment of FIGS. 3G-3I, the section of the groove is as described previously, that is to say that each lateral wall 38 of the groove 32 is of convex form and is dished axially towards the interior of the groove 32.

According to the embodiments represented in FIGS. 3J-3L and in FIGS. 3M-3O, the section of the groove 32 is in trapezoidal and octagonal form, respectively.

According to the embodiments represented in FIGS. 3J-3L and in FIGS. 3M-3O, the section of the groove 32 is in quadrilateral form and the outer end of a lateral wall 38 (FIGS. 3S-3U) or of the two lateral walls 38 (FIGS. 3P-3R) bears a lip 40.

The section of the seal 30 is chosen appropriately; it is for example circular in FIGS. 3A-3F and in FIGS. 3S-3U, it is oval in FIGS. 3J-3R and it is overall "four-lobe" in FIGS. 3G-3I.

Also, according to the embodiment represented in FIGS. 3V-3X, the section of the seal 30 is circular and complements the section of the groove 32, such that it is received without play in the groove 32 before the operation of injection moulding of the enclosure 18.

It will be understood that the examples of section of the seal 30 and of the groove 32 are given by way of illustration and that the invention is not limited to just these examples.

According to another aspect of the sealing means, when the seal 30 is mounted in the groove 32, before the operation of injection moulding of the enclosure 18, and as can be seen in the central drawing of each of FIGS. 3A to 3U, the seal 30 is received with play in the groove 32. Furthermore, a part of the seal 30 is situated outside of the groove 32.

According to a variant embodiment, when the seal 30 is mounted in the groove 32, before the operation of injection moulding of the enclosure 18, the seal 30 is received without play in the groove 32.

That makes it possible, during the injection moulding operation, for the pressure of the injected material to produce an elastic deformation of the seal 30 forcing it to be crushed and to penetrate additionally into the groove 32, as can be seen in the right-hand drawing of each FIG. 3A to 3U.

After the moulding operation, the seal 30 will then have a tendency to revert to its initial form and, since it will be prevented therefrom by the presence of the sleeve-forming part 24, it will consequently exert a bearing force against the inner face 26 of the sleeve-forming part 24.

Such a method for producing electrical switchgear 10 makes it possible to overmould the plastic material around the seal and the connector 16 in a single operation, with no risk of the seal 30 being displaced relative to the connector 16.

The seal-tightness between the connector 16 and the enclosure 18 is thus enhanced.

Furthermore, the respective forms of the seal 30 and of the groove 32 in which the seal 30 is introduced make it possible to remove the connector 16 out of the enclosure 18 without risk of the material of the enclosure 18 breaking or remaining linked to the connector 16.

Finally, these respective forms allow the seal 30 to remain in place on the connector 16 throughout the switchgear 10 production method, notably during the injection step, but also during the use of the switchgear 10.

The invention claimed is:

1. A method for producing low- or medium-voltage electrical switchgear comprising an electrical component, at least one electrical connector connected electrically to the electrical component and an enclosure delimiting a volume in which the electrical component is received, in which the electrical connector comprises a body which passes through the enclosure, the method comprising a step of fitting a seal in a peripheral groove formed in a wall of the body and a step of injecting a plastic material around the body of the electrical connector and around the seal, wherein the injection step consists of injecting the plastic material at a pressure causing an elastic crushing of the seal in the peripheral groove, and a dimension of at least part of the peripheral groove, measured along a main axis of the electrical connector, is less than a greatest axial dimension of the seal.

2. The method according to claim 1, wherein, on completion of the step of fitting the seal and before implementation of the injection step, a part of the seal is situated outside of the peripheral groove.

3. The method according to claim 2, wherein, on completion of the step of fitting the seal and before implementation of the injection step, a free volume is present between the seal and the peripheral groove.

4. A low- or medium-voltage electrical switchgear comprising:

an electrical component;

at least one connector having a main axis, which is electrically connected to the electrical component, and which comprises a body in an outer face of which a peripheral groove is formed;

an outer enclosure produced by plastic material injection which delimits a volume in which the electrical component is received, the body of the connector passing through the outer enclosure;

a seal which is arranged in the peripheral groove formed in the connector and which is covered by the outer enclosure, wherein the outer enclosure comprises a sleeve-forming part comprising an inner face which is facing and in contact with the outer face of the body of the connector and which is in contact with the seal, wherein the sleeve-forming part exerts on the seal a force compressing the seal in the peripheral groove, and a dimension of at least part of the peripheral groove, measured along the main axis of the connector, is less than a greatest axial dimension of the seal.

5. The electrical switchgear according to claim 4, wherein the peripheral groove comprises an opening where the peripheral groove emerges in the outer face of the body of which a length of the opening, measured along the main axis of the connector, is less than a greatest axial length of the at least part of the peripheral groove.

6. The electrical switchgear according to claim 5, wherein the at least part of the peripheral groove along an axial plane passing through the main axis of the connector has a form chosen from a rectangular quadrilateral, a portion of a circle, an oval, a trapezoid, or a hexagon.

7. The electrical switchgear according to claim 4, wherein the connector comprises a lip situated at one and/or another of two sides of an opening of the peripheral groove.

8. The electrical switchgear according to claim 4, wherein the connector comprises an end face situated outside the outer enclosure and the body of the connector includes two parts situated axially on either side of the peripheral groove, of which a diameter of a part which is situated axially closest to the end face of the body is of a diameter greater than the diameter of another of the two parts.

9. The electrical switchgear according to claim 4, wherein a cross section of the seal is of circular, annular or quadrilobal form.

10. The electrical switchgear according to claim 4, wherein the peripheral groove comprises a bottom face and two lateral walls which are convex, dished towards an interior of the peripheral groove and the seal is a seal of a four-lobe type.

* * * * *